US005637806A

United States Patent [19]

Baryshnikov et al.

[11] Patent Number: 5,637,806

[45] Date of Patent: Jun. 10, 1997

[54] PROCEDURE FOR EVALUATING THE FRICTION CHARACTERISTICS OF A SHOULDERED THREADED CONNECTION

[75] Inventors: Anatoly Baryshnikov, San Donato Milanese; Paolo Ferrara, Milan; Angelo Calderoni, San Donato Milanese, all of Italy

[73] Assignee: AGIP S.p.A., Milan, Italy

[21] Appl. No.: 498,702

[22] Filed: Jul. 3, 1995

[30] Foreign Application Priority Data

Jul. 13, 1994 [IT] Italy ..... MI94A1449

[51] Int. Cl.[6] ..... G01L 3/02

[52] U.S. Cl. ..... 73/862.21

[58] Field of Search ..... 73/9, 761, 84 B, 73/862.21, 862.23, 862.25

[56] References Cited

U.S. PATENT DOCUMENTS 4,633,702 1/1987 Kaiser et al. ..... 73/9

4,941,358 7/1990 Wing ..... 73/761

FOREIGN PATENT DOCUMENTS 0094509 11/1983 European Pat. Off. .

OTHER PUBLICATIONS

Soviet Journal of Friction and Wear, vol. 7, No. 3, pp. 131–135, 1986, D.N. Reshetov, et al., "Statistical Analysis of Friction Coefficients in Threaded Connections in Application to Reliability Calculations".

*Primary Examiner*—Elizabeth L. Dougherty

*Attorney, Agent, or Firm*—Oblon, Spivak, McClelland, Maier & Neustadt, P.C.

[57] ABSTRACT

Procedure for evaluating the parameter of actual $K_a$ total friction of a shouldered threaded connection which includes:

a) making up the connection applying a general make-up torque and observing the corresponding torque/turn diagram;

b) subsequently breaking out the connection observing the corresponding torque/turn diagram;

c) calculating the actual $K_a$ of the connection with an appropriate equation.

1 Claim, 1 Drawing Sheet

PROCEDURE FOR EVALUATING THE FRICTION CHARACTERISTICS OF A SHOULDERED THREADED CONNECTION

BACKGROUND OF THE INVENTION

1. Field of the Invention

The present invention relates to a procedure for evaluating the friction characteristics of a shouldered threaded connection or rotary threaded connection.

More specifically, the present invention relates to a procedure for evaluating, directly on the field, the friction characteristics of a general rotary threaded connection in a drillstring of a well for the production of hydrocarbons.

2. Discussion of Background

As it is known, drillstrings used in the drilling of the ground consist of a series of drill pipes joined to each other by rotary threaded connections. This type of connection guarantees, by pin/box contact, typically on a shoulder, the sealing of the mud inside the drillstring with respect to that outside.

The operating limits of a general shouldered threaded connection, and in particular those used in drilling operations, strictly depend on the make-up torque values applied to the drill pipe to be joined before putting them into action in the well. The determination of the optimum make-up torque value, for each pipe of the drillstring, is therefore an important condition for enabling the drilling operation with extremely precise safety margins and reliability.

The known methods presently used for determining the optimum make-up torque value are mainly based on a certain formula in whose determination the total $K_a$ friction parameter plays a determinant role; the latter puts the torque value during the make-up $M_{up}$ in relation with the forces which develop both on the shoulder and along the thread, $Q_{up}$, according to the relation:

$$M_{up}=K_aQ_{up}$$

The total $K_a$ friction parameter, sum of those relating to the shoulder, $K_s$, and along the thread, $K_t$, depends on several factors such as the geometry of the connection, the compound placed between the threads of the connection and the conditions of the contact surfaces (shoulder and thread) and may therefore vary within wide ranges during the duration of the connection depending on the variation of the above factors.

With this situation, the optimum make-up torque value can be obtained if the connection can be energized by producing a certain $Q_{up}$ value therein which is considered optimum. Consequently when the total $K_a$ friction value varies the optimum make-up value to be given to the connection, also varies.

An old API (American Petroleum Institute) regulation suggested that the optimum make-up value be measured independently of the compound placed between the threads which instead, as already mentioned, also determines the basic variations of the total friction parameter and therefore the optimum make-up.

API subsequently corrected this error by introducing the concept of the relative $R_f$ friction factor with which $K_a$, in the presence of a certain lubricating compound can be corrected on the basis of a reference $K_{a,ref}$ value, corresponding to the application on the thread of a reference compound, thus satisfying the following equation:

$$K_a=R_f\,K_{a,ref}$$

In particular, the new API regulation suggests a procedure for evaluating the relative $R_f$ friction factor which is basically based on the comparison between the slope of the torque/turn diagrams obtained by tightening, in the laboratory, a bolt previously treated with a reference lubricating compound and then with the compound to be examined.

FIG. 1, which is examplative, shows an example of a torque/turn diagram suitable for this type of calculation. In the ordinate there is the torque (M) applied during the make-up, in the abscissa the value of the relative rotation angle (Ω) between the pin and the box of the connection.

This angle starts being measured as soon as there is contact on the shoulder of the connection.

From the make-up of the bolt two curves are obtained having a different slope, $tg\phi_{up}$ relating to the make-up of the bolt treated with compound being tested and $tg\phi_{up,ref}$ with the reference compound. The relative friction factor results from the following equation:

$$R_f=tg\phi_{up}/tg\phi_{up,ref}$$

The system proposed by the known art to evaluate the total friction parameter has the disadvantage of not taking into consideration the actual connection and in particular the geometrical factor and the factor relating to the conditions of the contact surface of the connection which, as already mentioned, influence $K_a$ and therefore the optimum make-up torque value. In other words, the system of the known art indirectly evaluates the $K_a$ of the threaded connection at the beginning of its life-cycle and is not capable of taking into consideration the degree of wear of its contact surfaces.

SUMMARY OF THE INVENTION

The Applicant has now found a procedure which enables the direct evaluation of the total $K_a$ friction parameter of a shouldered threaded connection at any moment of the life of the connection and consequently taking into consideration not only the type of compound used but also the state of wear of the connection itself and any other factor which influences the $K_a$ at the moment of the make-up of the connection.

DESCRIPTION OF THE PREFERRED EMBODIMENT

The present invention therefore relates to a process for evaluating the actual $K_a$ total friction parameter of a shouldered threaded connection which comprises:

a) making up the connection applying a general make-up torque and observing the corresponding torque/turn diagram;

b) subsequently breaking out the connection observing the corresponding torque/turn diagram;

c) calculating the actual $K_a$ of the connection with one of the following equations:

$$K_a = \frac{p/\pi}{1 - \frac{tg\phi_{out}\,(\text{absolute value})}{tg\phi_{up}(\text{absolute value})}}$$

$$K_a = \frac{p/\pi}{1 - \frac{M_{out}}{M_{up}}}$$

wherein p represents the lead of thread, $tg\phi_{up}$ and $tg\phi_{out}$ represent the absolute values of the slopes of the torque/turn diagrams in the make-up and break out phase respectively, $M_{up}$ and $M_{out}$ represent the make-up and break out torque respectively.

Figure 1:
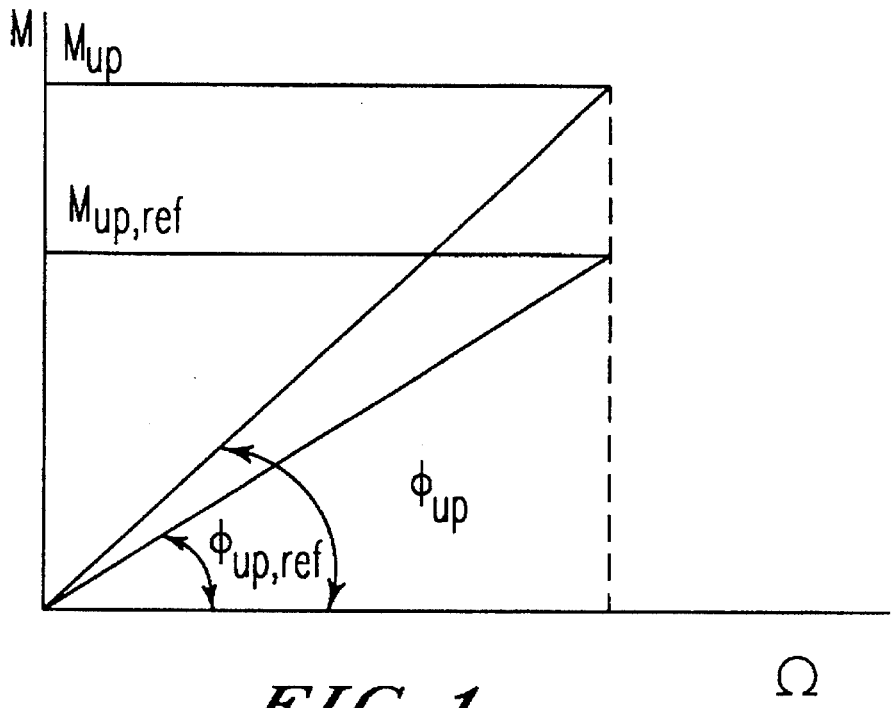
FIG. 1 PRIOR ART
FIG. 1 is an example of a known torque/turn diagram suitable for use in calculating the relative friction factor $R_f$.
Figure 2:
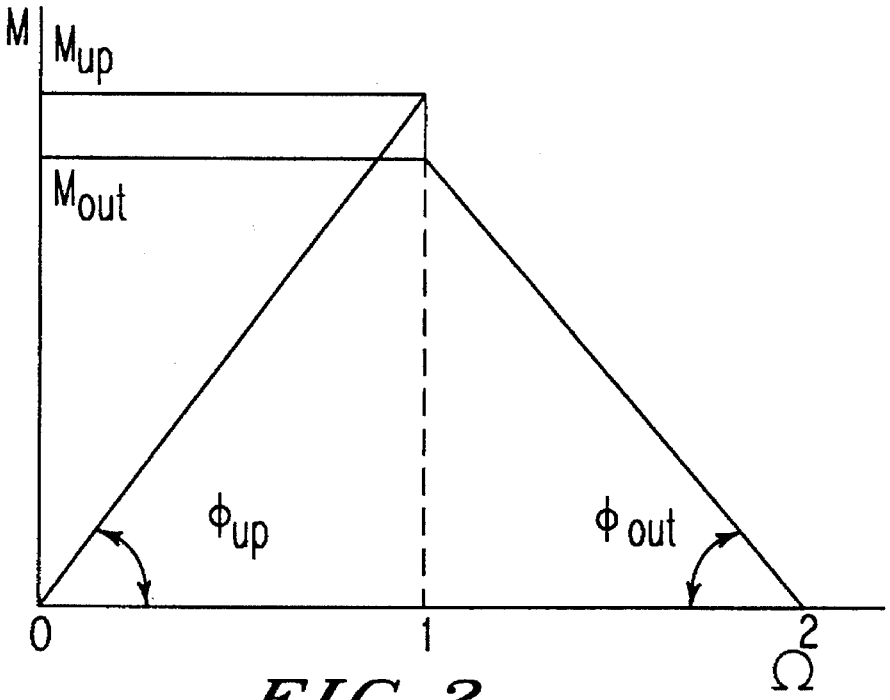
FIG. 2 is an example of a torque/turn diagram of the type contemplated by the present invention.

The slope $tg\phi_{out}$ of the line making the angle $\phi_{out}$ with the horizontal axis of the torque/turn diagram in FIG. 2 is negative. However, the distance from 0 to 1 along the horizontal axis of the torque/turn diagram in FIG. 2 represent the relative rotational angle between the pin and the box of the connection when making the threaded connection. As in FIG. 1, this angle starts being measured as soon as there is contact on the shoulder of the connection. The distance between 1 and 2 along the horizontal axis of FIG. 2 is equal to the distance between 0 and 1 and represents the relative rotational angle between the pin and box when the threaded connection is being broken. Thus, the bottom of the line making the angle $\phi_{out}$ with the horizontal axis in FIG. 2 could be shown as extending from the origin to the same upper end point illustrated in FIG. 2. In the latter case, the slope of the line making the angle $\phi_{out}$ with the horizontal axis would have a positive slope with the same absolute value as the line making the angle $\phi_{out}$ with the horizontal axis as illustrated in FIG. 2. Considering the equation for a straight line (i.e., y=(slope x+b), and the FIG. 2 torque/turn diagram, it is clear that the torque ratio $M_{out}/M_{up}$ is equal to the slope ratio of the absolute value of the slope $tg\phi_{out}$ of the line making the angle $\phi_{out}$ with the horizontal axis/absolute value of the slope $tg\phi_{up}$ of the line making the angle $\phi_{up}$ with the horizontal axis as illustrated in FIG. 2. That is, in the straight equations, "x" is the same and "b" may be taken as zero in each case.

The determination of the above formulae was made possible because it was discovered that the torque applied in the break out phase of the connection was less than the value applied in the make-up phase and that the slope of the torque/turn curve in the make-up phase is always greater than in the break out phase. These differences enable the above formulae to be determined using the diagrams of FIG. 2.

In fact in the make-up phase the following relation applies:

$$M_{up}=K_aQ_{up}$$

whereas in the break out phase the relation:

$$M_{out}=(K_a-p/\pi)Q_{up}$$

applies wherein $Q_{up}$ represents the axial forces on the shoulder and along the thread in both the make-up and break out phase.

We claim:

1. A procedure for measuring the actual total friction parameter $K_a$ of a shouldered threaded connection of threaded elements which procedure comprises:

a) (1) making a threaded connection by applying a general make-up torque and (2) observing a corresponding torque/turn diagram illustrating a torque applied in relation to the relative angle of rotation of one threaded element with respect to the other;

b) (1) subsequently breaking the threaded connection and (2) observing the corresponding torque/turn diagram;

c) calculating the actual $K_a$ of the connection with one of the following equations:

$$K_a = \frac{p/\pi}{1 - \frac{tg\phi_{out}\,(\text{absolute value})}{tg\phi_{up}(\text{absolute value})}}$$

$$K_a = \frac{p/\pi}{1 - \frac{M_{out}}{M_{up}}}$$

wherein p represents the lead of thread, $tg\phi_{up}$ and $tg\phi_{out}$ represent the absolute values of the slopes of the torque/turn diagrams in the making and breaking of the threaded connection respectively, $M_{up}$ and $M_{out}$ represent the maximum torque measured in making the threaded connection and the maximum torque measured in breaking the threaded connection respectively; and d) thereafter forming a threaded connection with said threaded elements by applying a make-up torque equal to $K_aQ_{up}$ wherein $Q_{up}$ is the desired force on the shoulder and along the thread of the threaded connection.

* * * * *